US008449085B2

(12) United States Patent
Chang

(10) Patent No.: US 8,449,085 B2
(45) **Date of Patent: *May 28, 2013**

(54) LIQUID EJECTION HEAD

(75) Inventor: Junhua Chang, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/460,192

(22) Filed: Apr. 30, 2012

(65) Prior Publication Data

US 2012/0218353 A1 Aug. 30, 2012

Related U.S. Application Data

(60) Continuation of application No. 13/191,816, filed on Jul. 27, 2011, now Pat. No. 8,182,074, which is a continuation of application No. 12/722,091, filed on Mar. 11, 2010, now Pat. No. 7,997,693, which is a division of application No. 11/557,902, filed on Nov. 8, 2006, now Pat. No. 7,708,388, which is a continuation of application No. 10/509,737, filed as application No. PCT/JP03/04535 on Apr. 9, 2003, now Pat. No. 7,140,554.

(30) Foreign Application Priority Data

Apr. 9, 2002 (JP) ..... 2002-106567

(51) Int. Cl.
*B41J 2/045* (2006.01)

(52) U.S. Cl.
USPC ..... 347/68

(58) Field of Classification Search
CPC ..... B41J 2002/14258; B41J 2002/14419
USPC ..... 347/68, 70–72
See application file for complete search history.

(56) References Cited

U.S. PATENT DOCUMENTS

| | | | | |
|---|---|---|---|---|
| 4,525,728 | A | 6/1985 | Koto | |
| 5,475,279 | A | 12/1995 | Takeuchi et al. | |
| 5,643,379 | A | 7/1997 | Takeuchi et al. | |
| 5,754,204 | A | 5/1998 | Kitahara | |
| 5,933,170 | A | 8/1999 | Takeuchi et al. | |
| 6,290,340 | B1 | 9/2001 | Kitahara et al. | |
| 6,352,330 | B1 | 3/2002 | Lubinsky et al. | |
| 6,412,926 | B1 * | 7/2002 | Okuda | 347/70 |

(Continued)

FOREIGN PATENT DOCUMENTS

| | | |
|---|---|---|
| EP | 0 787 589 A2 | 8/1997 |
| EP | 1 024 003 A2 | 8/2000 |

(Continued)

*Primary Examiner* — An Do
(74) *Attorney, Agent, or Firm* — Sughrue Mion, PLLC

(57) ABSTRACT

In order to provide a liquid ejection head which enables ejection of a droplet at a higher frequency, according to the invention, a piezoelectric vibrator 18 has a multilayer structure. In the multilayer structure, an upper piezoelectric layer 24 and a lower piezoelectric layer 25 are laminated one on another. A drive electrode 23 is formed at a boundary between the upper piezoelectric layer 24 and the lower piezoelectric layer 25 and is electrically connected to a source for supplying a drive signal. An upper common electrode 26 is formed on the surface of the upper piezoelectric layer 24. A lower common electrode 27 is formed on the surface of the lower piezoelectric layer 25. An inertance of a nozzle orifice 10 and an inertance of an ink supply port 5 are set so as to become greater than an inertance of a pressure generating portion 6, 13, 16.

10 Claims, 4 Drawing Sheets

U.S. PATENT DOCUMENTS

| | | | | |
|---|---|---|---|---|
| 6,450,603 | B1 | 9/2002 | Chang | |
| 6,557,985 | B2 | 5/2003 | Hosono et al. | |
| 6,719,410 | B2 | 4/2004 | Shingai et al. | |
| 6,796,637 | B2 | 9/2004 | Kitagawa et al. | |
| 6,997,547 | B2 | 2/2006 | Junhua | |
| 7,044,586 | B2 | 5/2006 | Takeuchi et al. | |
| 7,137,680 | B2 * | 11/2006 | Mataki | 347/10 |
| 7,140,554 | B2 | 11/2006 | Chang | |
| 7,708,388 | B2 * | 5/2010 | Chang | 347/68 |
| 8,061,819 | B2 * | 11/2011 | Suzuki | 347/68 |

FOREIGN PATENT DOCUMENTS

| | | | |
|---|---|---|---|
| JP | 61-141566 | A | 6/1986 |
| JP | 6-40035 | A | 2/1994 |
| JP | 8-290571 | A | 11/1996 |
| JP | 9-323410 | A | 12/1997 |
| JP | 10-146967 | A | 6/1998 |
| JP | 11-129468 | A | 5/1999 |
| JP | 11-320889 | A | 11/1999 |
| JP | 2000-117972 | A | 4/2000 |
| JP | 2000-218787 | A | 8/2000 |
| JP | 2001-047621 | A | 2/2001 |
| JP | 2001171115 | A | 6/2001 |
| JP | 2001-260308 | A | 9/2001 |
| JP | 2001-277496 | A | 10/2001 |
| JP | 2002-052713 | A | 2/2002 |
| WO | 01/42018 | A1 | 6/2001 |

* cited by examiner

LIQUID EJECTION HEAD

CROSS-REFERENCE TO RELATED APPLICATIONS

This is a Continuation application of application Ser. No. 13/191,816, filed on Jul. 27, 2011, which issued as U.S. Pat. No. 8,182,074 on May 22, 2012, which is a continuation of application Ser. No. 12/722,091, filed on Mar. 11, 2010, which issued as U.S. Pat. No. 7,997,693 on Aug. 16, 2011, which is a divisional of application Ser. No. 11/557,902 filed on Nov. 8, 2006, which issued as U.S. Pat. No. 7,708,388 on May 4, 2010, which is a Continuation of application Ser. No. 10/509,737 filed on Sep. 30, 2004, which issued as U.S. Pat. No. 7,140,554 on Nov. 28, 2006, which is a National Stage Entry of PCT Application No. PCT/JP03/04535, filed on Apr. 9, 2003, which claims priority from Japanese Patent Application 2002-106567 filed on Apr. 9, 2002. The entire disclosures of all the prior applications are considered part of the disclosure of this application and are hereby incorporated by reference in their entirety.

TECHNICAL FIELD

The invention relates to a liquid ejection head which causes pressure fluctuations in liquid stored in a pressure chamber by distortion of a piezoelectric vibrator, thereby ejecting the liquid from a nozzle orifice in the form of a droplet.

BACKGROUND ART

A liquid ejection head, which ejects liquid from a nozzle orifice in the form of a droplet by causing a pressure fluctuation in the liquid stored in a pressure chamber, includes a recording head, a liquid crystal ejection head, and a coloring material ejection head, for example. The recording head is to be provided in an image recording apparatus such as a printer or a plotter and ejects liquid ink in the form of ink droplets. The liquid crystal ejection head is to be used with a display manufacturing system for manufacturing a liquid crystal display. In the display manufacturing system, liquid crystal which has been ejected from a liquid crystal ejection head and assumes the form of a droplet is ejected toward a predetermined grid of a display substrate having a plurality of grids. The coloring material ejection head is to be used with a filter manufacturing system for manufacturing a color filter and ejects a coloring material on the surface of a filter substrate.

Such a liquid ejection head comes in various types. One type of such a liquid ejection heads ejects a droplet by flexural deformation of a piezoelectric vibrator formed on the surface of a vibration plate. The liquid ejection head comprises an actuator unit having, e.g., a pressure chamber and a piezoelectric vibrator; and a channel unit having nozzle orifices and a common liquid chamber. The liquid ejection head varies the volume of the pressure chamber by deforming the piezoelectric vibrator, which is provided on a vibration plate, thereby causing pressure fluctuations in the liquid stored in the pressure chamber. By utilization of the pressure fluctuations, a droplet is ejected from the nozzle orifice. For instance, liquid is compressed by contraction of the pressure chamber, thereby squeezing the liquid out of the nozzle orifice.

In general, the above piezoelectric vibrator has a single-layer structure comprising: a piezoelectric layer; a drive electrode formed on one surface of the piezoelectric layer and electrically connected to a supply source of a drive signal; and a common electrode formed on the other surface of the piezoelectric layer. Since the size of the piezoelectric vibrator is determined in accordance with an area of the pressure chamber, the deformable amount of the piezoelectric vibrator in the liquid ejection head is approximately 0.11 μm at most. Namely, if the voltage applied between the electrodes is increased to increase the deformed amount of the piezoelectric vibrator, the stress is concentrated to the joining face of the piezoelectric vibrator and the vibration plate, so that the piezoelectric layer is peeled off the vibration plate. In order to avoid this problematic situation, the thickness of the piezoelectric vibrator may be increased. However, it is impractical because more time would be necessary for fabricating such a thick piezoelectric vibrator, thereby increasing costs.

DISCLOSURE OF THE INVENTION

There exists strong demand for a liquid ejection head which effects high-frequency ejection of a droplet. In order to effect high-frequency ejection, the natural period Tc of the pressure chamber must be shortened. The reason for this is that the ejection timing of a droplet is defined on the basis of the natural period.

Specifically, pressure vibrations of the natural period Tc arise in the liquid, for reasons of fluctuation of the volume of the pressure chamber. A meniscus (free surface of liquid exposed in a nozzle orifice) also vibrates at the natural period Tc. In other words, within the nozzle orifice, the meniscus reciprocally moves between an ejecting direction and a direction toward the pressure chamber. The quantity of a droplet to be ejected and the flight velocity of the droplet vary in accordance with the state of the meniscus (i.e., the position and moving direction of the meniscus) achieved when the pressure chamber contracts and expands. In order to eject droplets which are essentially equal in quantity and flight velocity, the state of the meniscus achieved at the time of contraction and expansion of the pressure chamber must be made uniform. Consequently, when droplets are to be ejected continuously, the timing at which the droplets are to be ejected is defined as "n" times the natural period Tc. Shortening the natural period Tc is indispensable for effecting high-frequency ejection of a droplet.

The invention has been conceived in view of the circumstances and aims at providing a liquid ejection head capable of ejecting a droplet at a higher frequency.

In order to achieve the above object, according to the invention, there is provided a liquid ejection head, comprising:

a pressure generating portion, provided in an ink channel communicating a common ink chamber and a nozzle orifice;

a vibration plate, which defines a part of the pressure generating portion, so that liquid in the pressure generating portion is ejected from the nozzle orifice as a liquid droplet by deforming the vibration plate;

a piezoelectric vibrator, provided on a surface of the vibration plate which is opposite to a surface facing the pressure generating portion; and a liquid supply port, arranged between the common ink chamber and the pressure generating portion to serve as an orifice, wherein the piezoelectric vibrator has a multilayer structure which comprises:

an upper piezoelectric layer and a lower piezoelectric layer, laminated one on another;

a drive electrode, formed at a boundary between the upper piezoelectric layer and the lower piezoelectric layer, and electrically connected to a supply source of a drive signal;

an upper common electrode, formed on a surface of the upper piezoelectric layer; and a lower common electrode, formed on a surface of the lower piezoelectric layer; and wherein an inertance of the nozzle orifice and an inertance of the liquid supply port are greater than an inertance of the pressure generating portion.

With this configuration, the natural period of the pressure generating portion can be shortened, thereby achieving the high-frequency ejection of liquid droplets.

BEST MODE FOR CARRYING OUT THE INVENTION

Figure 1:
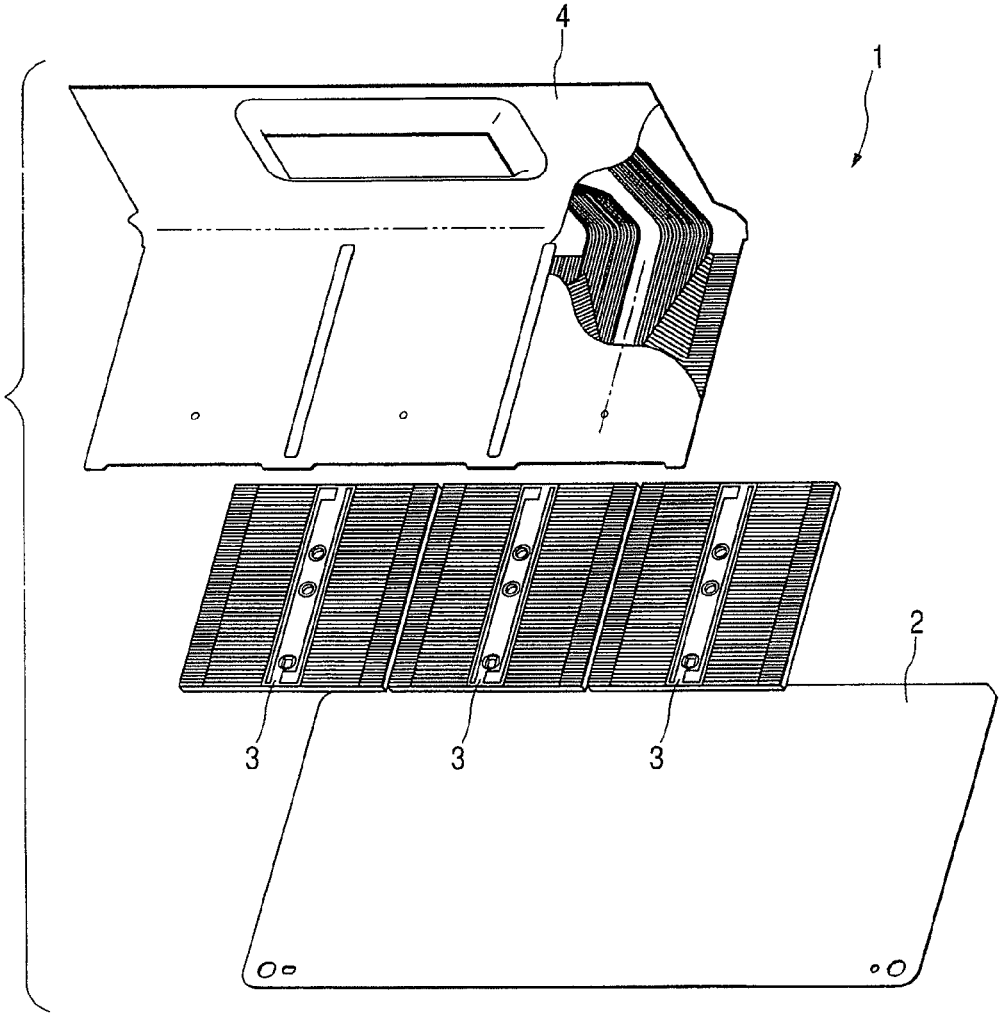
FIG. 1 is an exploded perspective view for explaining the configuration of a recording head.

One embodiment of the invention will now be described below. As shown in FIG. 1, a liquid ejection head will be described by taking, as an example, an inkjet recording head (hereinafter referred to as a "recording head") to be provided on an image recording apparatus such as a printer or a plotter. The recording head is essentially constituted of a channel unit 2, an actuator unit 3, and a film-shaped wiring board 4. A plurality of actuator units 3 are arranged side by side on and joined to the surface of the channel unit 2. The wiring board 4 is provided on the other surface of the actuator units 3 opposite the surface having the channel unit 2 provided thereon.

Figure 2A:
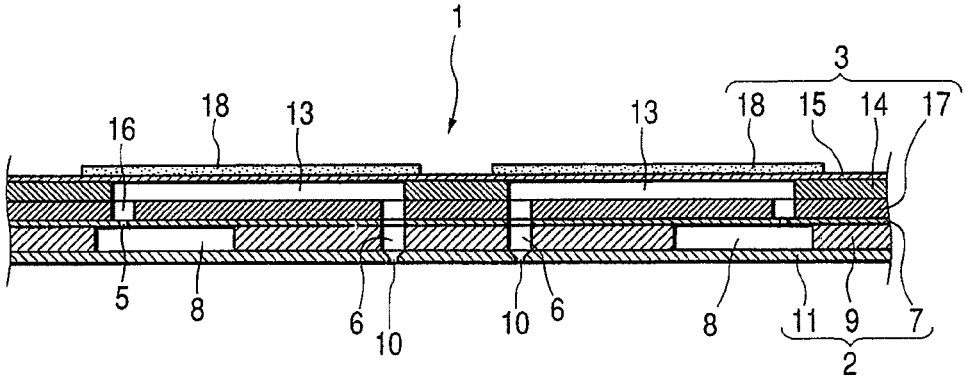
FIGS. 2A and 2B are a cross-sectional view for explaining an actuator unit and a channel unit, and an enlarged partial view for explaining a nozzle plate.
Figure 3:
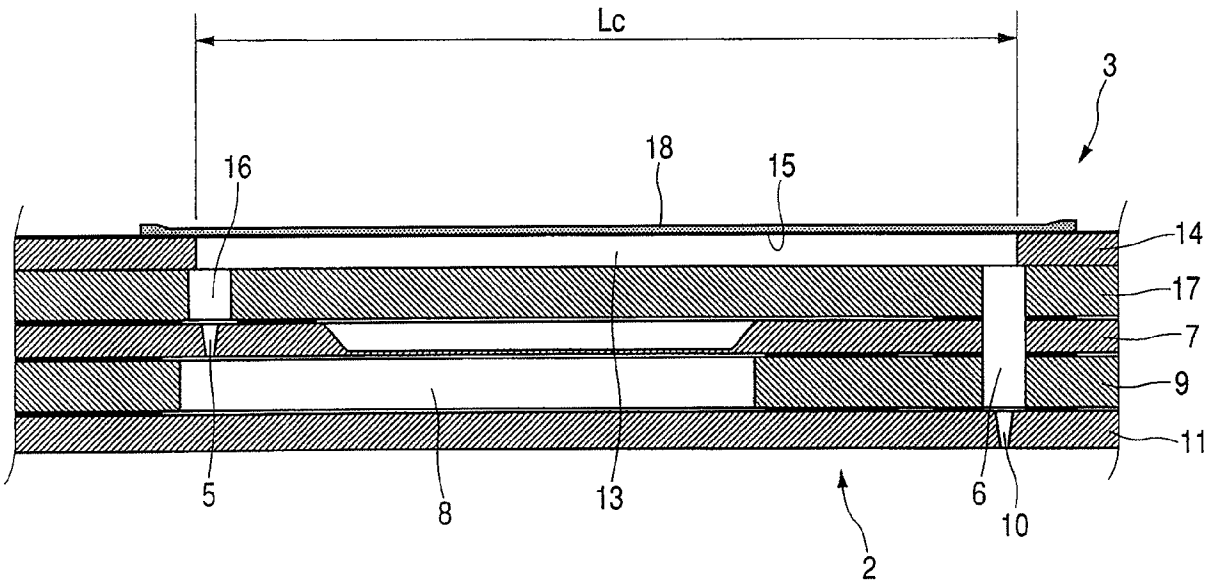
FIG. 3 is a cross-sectional view for explaining the actuator unit and the channel unit.

As can be seen from cross-sectional views shown in FIGS. 2A and 3, the channel unit 2 is fabricated from a supply port formation substrate 7 in which are formed an ink supply port 5 (a liquid supply port according to the invention) and through holes to constitute portions of nozzle communication ports 6; an ink chamber formation substrate 9 in which are formed through holes to act as a common ink chamber 8 and through holes to constitute a portion of the nozzle communication port 6; and a nozzle plate 11 in which are formed nozzle orifices 10 in a secondary scanning direction. The supply port formation substrate 7, the ink chamber formation substrate 9, and the nozzle plate 11 are formed by pressing, for example, a stainless steel plate. In this embodiment, the supply port formation substrate 7 assumes a thickness of 100 μm; the ink chamber formation substrate 9 assumes a thickness of 150 μm; and the nozzle plate 11 assumes a thickness of 80 μm.

The drawings show a portion of the channel unit 2. Specifically, the portion corresponds to one actuator unit 3. In the embodiment, three actuator units 3 are joined to one channel unit 2. Hence, the ink supply port 5, the nozzle communication port 6, the supply port formation substrate 7, the common ink chamber 8, and the like are formed for each actuator unit. Hence, they are provided in a total of three sets.

The channel unit 2 is fabricated by placing the nozzle plate 11 on one surface of the ink chamber formation substrate 9 (e.g., a lower surface in the drawing) and the supply port formation substrate 7 on the other surface of the same (e.g., an upper surface in the drawing), and bonding together the supply port formation substrate 7, the ink chamber formation substrate 9, and the nozzle plate 11. For instance, the channel unit 2 is fabricated by bonding together the members 7, 9, and 11 by use of, e.g., a sheet-shaped adhesive.

The nozzle orifice 10 is a circular passage having a very small diameter. The nozzle orifice is a tapered passage which becomes smaller in diameter toward a nozzle surface (i.e., the exterior surface of the nozzle plate 11). In the embodiment, an external opening of the nozzle orifice 10 facing the nozzle surface assumes a diameter of 20 μm, and the length of the passage is identical with the thickness of the nozzle plate 11; that is, 80 μm. Further, the nozzle orifice has a cone angle of 35 degrees.

Figure 2B:
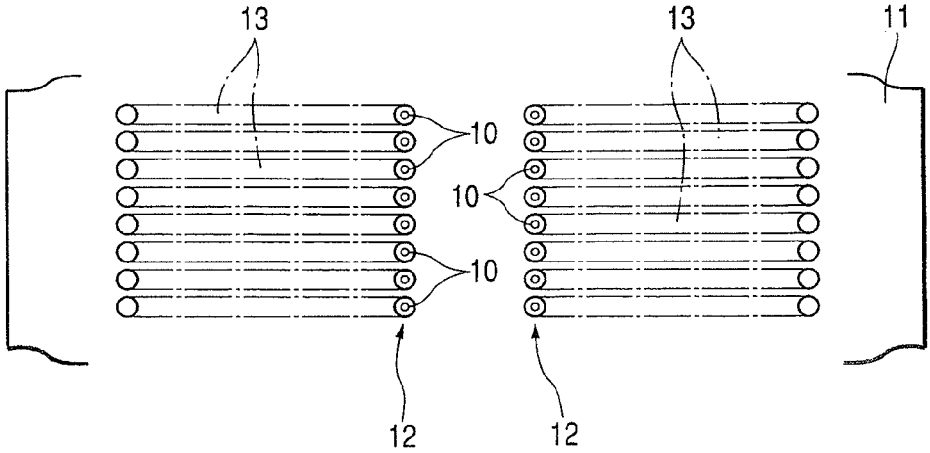

As shown in FIG. 2B, the nozzle orifices 10 are formed in a plurality of rows at predetermined pitches. Rows of nozzles 12 are formed from the plurality of nozzle orifices 10 arranged in rows. For example, a row of nozzles 12 is formed from 92 nozzle orifices 10. Two rows of nozzles 12 are formed for one actuator unit 3. Therefore, in the embodiment, a total of six rows of nozzles 12 are formed side by side for one channel unit 2.

The ink supply port 5 is a circular passage having a very small diameter, as in the case of the nozzle orifice 10, and acts as an orifice. An opening of the ink supply port 5 facing the pressure chamber (i.e., a feeding-side communication port) is larger in diameter than an opening of the same facing the common ink chamber 8. The ink supply port 5 is a tapered passage which becomes smaller in diameter toward the common ink chamber 8. In the embodiment, the external opening of the ink supply port 5 facing the common ink chamber 8 assumes a diameter of 20 μm, and the passage length of the ink supply port is identical with the thickness of the supply port formation substrate 7; that is, 100 μm. The ink supply port 5 assumes a cone angle of 35 degrees.

The actuator unit 3 is also called a head chip and is a kind of piezoelectric actuator. As shown in FIG. 2A, the actuator unit 3 comprises a pressure chamber formation substrate 14 in which a through hole to constitute a pressure chamber 13 is formed; a vibration plate 15 which partitions a part of the pressure chamber 13; a cover member 17 in which are formed a through hole to constitute a supply-side communication port 16 and a through hole to constitute a portion of the nozzle communication port 6; and a piezoelectric vibrator 18. In relation to the thicknesses of the members 14, 15, and 17, the pressure chamber formation substrate 14 and the cover member 17 preferably assume a thickness of 50 μm or more each, more preferably, 100 μm or more. In the embodiment, the thickness of the pressure chamber formation substrate 14 is set to 80 μm, and the thickness of the cover member 17 is set to 150 μm. The vibration plate 15 preferably assumes a thickness of 50 μm or less, more preferably 3 to 12 μm or thereabouts. In the embodiment, the vibration plate 15 is set to a thickness of 6 μm.

The actuator unit 3 is made by placing the cover member 17 on one surface of the pressure chamber formation substrate 14 and the vibration plate 15 on the other surface of the same, and by bonding together the members 14, 15, and 17. The pressure chamber formation substrate 14, the vibration plate 15, and the cover member 17 are made from ceramics, such as alumina or zirconia, and are integrated together by sintering.

For instance, a green sheet (a sheet member which has not yet been sintered) is subjected to processing, such as cutting or punching, thereby forming required through holes. Thus, sheet-shaped precursors for use in forming the pressure chamber formation substrate 14, the vibration plate 15, and the cover member 17 are formed. The sheet-shaped precursors are laminated and sintered, thereby integrating the sheet-shaped precursors into a single ceramic sheet. In this case, since the respective sheet-shaped precursors are sintered integrally, special bonding operation is not required. Moreover, a high sealing characteristic can also be achieved at joined surfaces between the respective sheet-shaped precursors.

The pressure chambers 13 and the nozzle communication ports 6, which are equal in number to units, are formed in one ceramic sheet. Specifically, a plurality of actuator units (head chips) 3 are formed from one ceramic sheet. For instance, a plurality of chip areas, which are to become single actuator units 3 respectively, are set in a matrix pattern within one ceramic sheet. After a required member, such as the piezoelectric element 18, has been formed in each chip area, the ceramic sheet is sliced for each chip area, thereby fabricating a plurality of actuator units 3.

Figure 4:
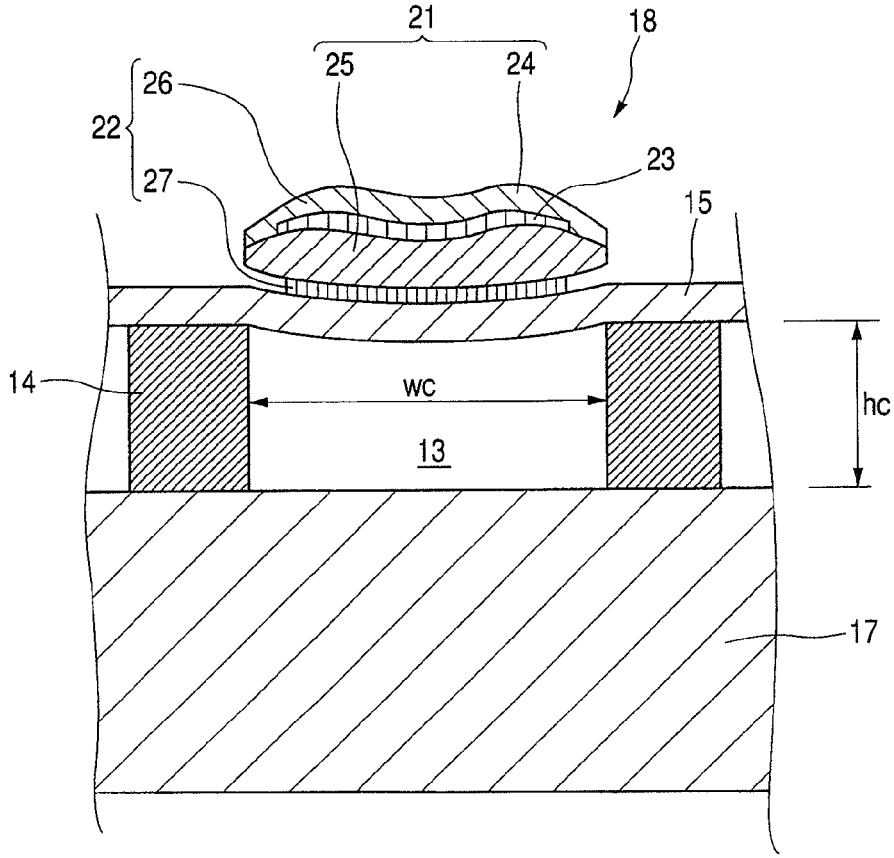
FIG. 4 is an enlarged cross-sectional view of the actuator unit sliced in the widthwise direction of a pressure chamber.

The pressure chamber 13 is a rectangular-parallelepiped hollow section which is elongated in the direction orthogonal to the row of nozzles 12, and a plurality of pressure chambers 13 are formed so as to correspond to the nozzle orifices 10. Specifically, as shown in FIG. 2B, the pressure chambers 13 are arranged in rows aligned with the row of nozzles. As shown in FIGS. 3 and 4, the pressure chamber 13 of the embodiment has a height hc of 80 μm, a width we of 160 μm, and a length Lc of 1.1 mm. In other words, the ratio between a height, a width, and a length is set to about 1:2:14. Since the deformable amount of the piezoelectric vibrator 18 is so determined as to be 0.17 μm, the length Lc of the pressure chamber 13 is so determined as to be 1.1 mm as described the above, in view of the amount of an ink droplet to be ejected (3 pL or less, described later). One longitudinal end of each of pressure chambers 13 is in communication with the corresponding nozzle orifice 10 by way of the nozzle communication port 6. The other longitudinal end of each of the pressure chambers 13 is in communication with the common ink chamber 8 by way of the supply-side communication port 16 and the ink supply port 5. A part of the pressure chamber 13 (i.e., an upper surface thereof) is partitioned by the vibration plate 15.

The piezoelectric vibrator 18 is a piezoelectric vibrator of so-called flexural vibration mode and is provided, for each pressure chamber 13, on the surface of the vibration plate opposite the pressure chamber 13. As shown in FIGS. 3 and 4, the piezoelectric vibrator 18 assumes the form of a block which is elongated in the longitudinal direction of the pressure chamber. In the embodiment, the piezoelectric element 18 has a width substantially equal to that of the pressure chamber 13, and a length of 160 μm. Further, the piezoelectric vibrator 18 is somewhat greater in length than the pressure chamber 13, and both ends of the piezoelectric vibrator 18 are arranged so as to extend beyond longitudinal ends of the pressure chamber 13.

As shown in FIG. 4, the piezoelectric vibrator 18 of the embodiment is formed from a piezoelectric layer 21, a common electrode 22, and a drive electrode 23 (an individual electrode), or the like. The piezoelectric layer 21 is sandwiched between the common electrode 22 and the drive electrode 23. A supply source of a drive signal (not shown) is electrically connected to the drive electrode 23 via the individual terminal. The common electrode 22 is controlled to, e.g., an earth potential. When a drive signal is supplied to the drive electrode 23, an electric field whose intensity is related to a potential difference between the drive electrode 23 and the common electrode 22 develops. When the electric field is imparted to the piezoelectric layer 21, the piezoelectric layer 21 becomes distorted in accordance with the intensity of the imparted electric field.

In the piezoelectric vibrator 18 of the embodiment, the piezoelectric layer 21 is constituted by an upper (outer) piezoelectric layer 24 and a lower (inner) piezoelectric layer 25. The common electrode 22 is formed from an upper common electrode (an external common electrode) 26 and a lower common electrode (an internal common electrode) 27. The common electrode 22 and the drive electrode 23 (i.e., the individual electrode) constitute an electrode layer.

Here, the orientations "up (external)" and "down (internal)" indicate positional relationships defined with reference to the vibration plate 15. Specifically, the term "up (external)" indicates a position distant from the vibration plate 15, and the term "down (internal)" indicates a position close to the vibration plate 15.

The drive electrode 23 is formed along a boundary between the upper piezoelectric layer 24 and the lower piezoelectric layer 25. The lower common electrode 27 is formed between the lower piezoelectric layer 25 and the vibration plate 15. The upper common electrode 26 is formed on the surface of the upper piezoelectric layer 24 opposite the lower piezoelectric layer 25. More specifically, the piezoelectric vibrator 18 is of a multilayer structure into which the lower common electrode 27, the lower piezoelectric layer 25, the drive electrode 23, the upper piezoelectric layer 24, and the upper common electrode 26 are stacked, in this sequence from the vibration plate 15.

In relation to the thickness of the piezoelectric layer 21, the thickness of the upper piezoelectric layer 24 and that of the lower piezoelectric layer 25 are set to a value of 10 μm or less. In the embodiment, the thickness of the upper piezoelectric layer 24 is set to 8 μm, and the thickness of the lower piezoelectric layer 25 is set to 9 μm. Thus, the total thickness of the piezoelectric layer 21 is set to 17 μm. Further, the overall thickness of the piezoelectric vibrator 18, including the common electrode 22, is set to a value of about 20 μm. The thickness of the piezoelectric vibrator 18 can be set in this way, and hence required rigidity can be obtained, thereby diminishing the compliance of the vibration plate 15.

The upper common electrode 26 and the lower common electrode 27 are controlled to a given potential regardless of the drive signal. In the embodiment, the upper common electrode 26 and the lower common electrode 27 are electrically connected together and controlled to the earth potential. The drive electrode 23 is electrically connected to the drive signal supply source and, hence, changes a potential in accordance with a supplied drive signal. Accordingly, supply of the drive signal induces an electric field between the drive electrode 23 and the upper common electrode 26 and an electric field between the drive electrode 23 and the lower common electrode 27, wherein the electric fields are opposite in direction to each other.

Various conductors; e.g., a single metal substance, a metal alloy, or a mixture consisting of electrically insulating ceramics and metal, are selected as materials which constitute the electrodes 23, 26, and 27. The materials are required not to cause any deterioration at a sintering temperature. In the embodiment, gold is used for the upper common electrode 26, and platinum is used for the lower common electrode 27 and the drive electrode 23.

The upper piezoelectric layer 24 and the lower piezoelectric layer 25 are formed from piezoelectric material containing lead zirconate titanate (PZT) as the main ingredient. The direction of polarization of the upper piezoelectric layer 24 is opposite that of the lower piezoelectric layer 25. Therefore, when the drive signal is applied to the upper piezoelectric layer 24 and the lower piezoelectric layer 25, the layers expand and contract in the same direction and can become deformed without any problem. Specifically, the upper piezoelectric layer 24 and the lower piezoelectric layer 25 deform the vibration plate 15 such that the volume of the pressure chamber 13 is reduced with an increase in the potential of the drive electrode 23 and such that the volume of the pressure chamber 13 is increased with a decrease in the potential of the drive electrode 23.

The amount of displacement of the piezoelectric vibrator 18 stemming from supply of a drive signal is set to a value of 0.16 μm or more by use of the piezoelectric vibrator 18 of multilayer structure. In this embodiment, it is set to a value of 0.17 μm. As a result, ink droplets of quantity required to perform recording operation can be ejected from the nozzle orifice 10.

The compliance of the piezoelectric vibrator 18 is set to a value equal to or smaller than the compliance of ink (Ci which will be described later) by use of the piezoelectric vibrator 18 of a multilayer structure. As a result, the influence of variations in compliance of the piezoelectric vibrator 18 stemming from manufacturing operation can be diminished. Ink droplets can be ejected with the pressure chambers 13 being set to a uniform flying speed and a uniform quantity.

In the piezoelectric vibrator 18 of the multilayer structure, an electric field, which is determined in accordance with an interval between the drive electrode 23 and each of the common electrodes 26, 27 (i.e., the thickness of each piezoelectric layer) and a potential difference between the drive electrode 23 and each of the common electrodes 26, 27, is applied to each of the piezoelectric layers 24, 25. Hence, the thickness of each of the piezoelectric layers 24, 25 can be reduced in comparison with the piezoelectric vibrator of the single layer structure in which a single piezoelectric layer is sandwiched by a drive electrode and a common electrode. Further, even if the entire thickness of the piezoelectric vibrator is increased to reduce the compliance of a deformable portion, a larger deformed amount can be attained with the same drive potential. Moreover, since the thickness of each of the piezoelectric layers 24, 25 can be reduced, the stress can be also reduced.

The actuator unit 3 and the channel unit 2 are joined together. For instance, a sheet-shaped adhesive is interposed between the supply port formation substrate 7 and the cover member 17. In this state, pressure is applied to the actuator unit 3 toward the channel unit 2, whereupon the actuator unit 3 and the channel unit 2 are bonded together.

One end of the pressure chamber 13 and the nozzle orifice 10 are brought into communication with each other by the nozzle communication port 6 through bonding action. Moreover, the other end of the pressure chamber 13 and the ink supply port 5 are brought into communication with each other by the supply-side communication port 16. The nozzle communication port 6 and the supply-side communication port 16 are formed from passages, each assuming a circular cross-sectional profile. The nozzle communication port 6 of the embodiment is formed from a passage which has a diameter of 125 μm and a length of 400 μm. The supply-side communication port 16 is formed from a passage which has a diameter of 125 μm and a length of 150 μm.

In the recording head 1 having such a construction, a string of ink flow passages are formed for each nozzle orifice 10 so as to extend from the common ink chamber 8 to the nozzle orifice 10 by way of the ink supply port 5, the supply-side communication port 16, the pressure chamber 13, and the nozzle communication port 6. When the recording head is in use, the inside of each ink flow passage is filled with ink. A corresponding pressure chamber 13 expands or contracts by deforming the piezoelectric vibrator 18, thereby causing pressure fluctuations in the ink stored in the pressure chamber 13. By controlling the ink pressure, the nozzle orifice 10 can eject an ink droplet. For instance, if the pressure chamber 13 having a fixed volume is once expanded to fill the pressure chamber 13 with ink. Subsequently, the pressure chamber 13 is rapidly contracted to eject an ink droplet. When the ink droplet has been ejected from the nozzle orifice 10, new ink is supplied into the ink flow passage from the common ink chamber 8, so that ink droplets can be ejected continuously.

As mentioned above, in the recording head 1 arranged such that the nozzle orifice 10 ejects an ink droplet by causing pressure fluctuations in the ink stored in the pressure chamber 13, pressure vibrations (or natural vibrations of ink), which behave as if the inside of the pressure chamber 13 were a sounding tube, are induced by the pressure fluctuations in the ink stored in the pressure chamber 13.

Here, high-speed recording operation involves a necessity for ejecting a larger number of ink droplets within a short period of time. In order to satisfy this requirement, the natural period Tc of the ink stored in the pressure chamber 13 must be set as small as possible. The natural period Tc can be expressed by Equation 1.

$$Tc=2\pi\sqrt{(Ci+Cv)[Mu+(Mc/2)][Ms+(Mc/2)]/(Mu+Ms+Mc)} \quad (1)$$

where Ci denotes compliance of the ink stored in the pressure generating portion; Cv denotes rigidity compliance of the pressure chamber formation substrate 14; Mn denotes the inertance of the nozzle orifice 10; Ms denotes the inertance of the ink supply port 5; and Mc denotes the inertance of the pressure generating portion.

Here, the pressure generating portion is constituted by hollow sections formed between the nozzle orifice 10 and the ink supply port 5. In this embodiment, the pressure generating portion is constituted by hollow sections including the pressure chamber 13, the nozzle communication port 6, and the supply-side communication port 16. Since the pressure chamber 13, the nozzle communication port 6, and the supply-side communication port 16 are substantially equal in cross sectional area, the inertance Mc of the pressure generating portion can be expressed by Equation 2.

$$Mc\cong\rho Lc/Sc \quad (2)$$

where ρ denotes the density of ink; Lc denotes the length of the pressure chamber 13; and Sc denotes the cross section of the pressure chamber 13. The inertance Ms of the ink supply port 5 can be expressed by Equation 3.

$$Ms=\rho Ls/Ss \quad (3)$$

where ρ denotes the density of ink; Ls denotes the length of the ink supply port 5; and Ss denotes the cross section of the ink supply port 5. Similarly, the inertance Mn of the nozzle orifice 10 can be expressed by Equation 4.

$$Mn=\rho Ln/Sn \quad (4)$$

where ρ denotes the density of ink; Ln denotes the length of the nozzle orifice 10; and Sn denotes the cross section of the nozzle orifice 10.

In relation to the length of the flow passage in the pressure generating portion, the thickness of each substrate is essentially limited to a predetermined thickness. Hence, the length of the supply-side communication port 6 and that of the nozzle communication port 16 assume a substantially constant value. Hence, the inertance Mc of the pressure generating portion is substantially dominated by the length Lc of the pressure chamber 13.

The rigidity compliance Cv of the pressure chamber formation substrate 14 is an element for dominantly defining the compliance of the pressure chamber 13. The rigidity compliance Cv is a volume change ΔV with respect to a pressure change ΔP and hence can be expressed as Equation (5).

$$Cv=\Delta V/\Delta P \quad (5)$$

Here, in view of an attempt to reduce variations in compliance of the pressure chamber 13, in this embodiment the rigidity compliance Cv is set to become equal to or less than the compliance Ci of the ink. When the rigidity compliance Cv is set to become equal to or less than the compliance Ci of the ink in the manner as mentioned previously, the proportion of the compliance Ci of the ink accounting for the compliance of the pressure chamber 13 becomes relatively greater than the proportion of the rigidity compliance Cv. Therefore, variations in the machining precision of a pressure chamber constituting member, such as a partition partitioning adjacent pressure chambers 13 and the vibration plate 15, become less likely to affect the ejection characteristic of an ink droplet.

From the viewpoint of minimization of the natural period Tc, the inertance Mn of the nozzle orifice 10 and the inertance Ms of the ink supply port 5 are set so as to become greater than the inertance Mc of the pressure generating portion. As mentioned above, the length Lc of the pressure chamber 13 is made as small as possible, and the inertance Mc of the pressure generating portion is made so as to become smaller than the inertance Mn of the nozzle orifice 10 and the inertance Ms of the ink supply port 5. In this way, when the inertance Mc has become small, the compliance Ci of ink and the rigidity compliance Cv change in direct proportion to the length Lc of the pressure chamber 13. Concurrently, the compliance Ci of the ink and the rigidity compliance Cv also become smaller. Consequently, the natural period Tc can be shortened. Another measure for increasing the cross section Sc of the pressure chamber 13 so as to become larger than that achieved hitherto is also conceivable for reducing the inertance Mc. In this case, the compliance Ci of the ink and the rigidity compliance Cv also become greater, and hence the natural period Tc cannot be shortened.

Since the inertance Mc is reduced by shortening the length Lc of the pressure chamber 13, the amount of displacement (distortion) of the piezoelectric vibrator 18 is reduced correspondingly. The quantity of ink droplet is also reduced. Therefore, very small dots can be recorded. As mentioned above, in the embodiment, the diameter of the nozzle orifice 10 is set to a value smaller than the conventional value (e.g., 25 μm); that is, 20 μm, thereby increasing the inertance Mn of the nozzle orifice 10. Hence, an ink droplet can be ejected at high speed.

In the embodiment, the inertance Mn of the nozzle orifice 10 and the inertance Ms of the ink supply port 5 are each set to a value which is double or more the inertance Mc of the pressure generating portion. The reason for this is that the influence of the natural period Tc due to the pressure generating portion is made ineffective without fail.

Specifically, the length of the pressure chamber 13 is set such that relationships, that is, $Mn \geqq 2Mc$ and $Ms \geqq 2Mc$; more specifically, the length of the pressure chamber 13 is set to a length of 1.1 mm or less, the natural period Tc is defined in terms of the inertance Mn of the nozzle orifice 10 and the inertance Ms of the ink supply port 5.

Even when variations have arisen in the geometry of the pressure chamber 13, variations in the natural period Tc can be much reduced by manufacturing the nozzle orifice 10 and the nozzle communication port 6 with superior dimensional accuracy. As a result, variations in the characteristic of an ink droplet of each pressure chamber 13 can be considerably reduced.

As mentioned above, the inertance Mc is reduced by shortening the length Lc of the pressure chamber 13. Hence, the amount of displacement (distortion) of the piezoelectric vibrator 18 is reduced correspondingly. In view of this point, the piezoelectric vibrator 18 of a multilayer structure is used in the embodiment in the manner as mentioned previously, thereby increasing the force developing in the piezoelectric vibrator 18. Even in this regard, an ink droplet of very small quantity (e.g., an ink droplet of 3 pL to 6 pL) can be ejected at high speed.

Consequently, the natural period Tc can be shortened to a value of 7 μs or less (6.5 μs in the embodiment). As a result, an ink droplet of 6 pL or more can be ejected at a frequency of 50 kHz or higher. Further, an ink droplet of 3 pL or less can be ejected at a frequency of 30 kHz or higher. Accordingly, the quantity of one ink droplet can be made smaller than that of a conventional ink droplet. A frequency at which an ink droplet is to be ejected can be made higher than a conventional frequency, and hence high image quality of a recorded image and high-speed recording can be achieved simultaneously at a higher level.

Since the length of the pressure chamber 13 can be shortened when compared with the length of a conventional pressure chamber, cost reduction can also be attempted. Specifically, the length of the pressure chamber 13 is shorter than that of a conventional pressure chamber, and hence the number of actuator units 3 which can be laid out in one ceramic sheet can be increased. Hence, the actuator units 3 can be manufactured in greater number than those manufactured conventionally even by employment of the same manufacturing process (i.e., the same operations). The actuator units 3, can be manufactured from the same quantity of raw material in greater number than those manufactured conventionally. As mentioned above, an attempt can be made to improve a manufacturing efficiency and saving of material costs, and hence cost-cutting of the recording head 1 can be realized.

Further, even when the dimensional precision of the pressure chamber 13 is set rougher than a conventional dimensional precision, a uniform natural period Tc can be achieved with high precision. Hence, an attempt to improve a yield can be realized. Even in this regard, cost-cutting of the recording head 1 can be achieved.

INDUSTRIAL APPLICABILITY

The invention has been described by taking the recording head 1 as an example of the liquid ejection head. However, the invention can also be applied to another liquid ejection head, such as a liquid-crystal ejection head or a coloring material ejection head.

DESCRIPTION OF REFERENCE NUMERALS

1 INKJET RECORDING HEAD
2 CHANNEL UNIT
3 ACTUATOR UNIT
4 WIRING BOARD
5 INK SUPPLY PORT
6 NOZZLE COMMUNICATION PORT
7 SUPPLY PORT FORMATION BOARD
8 COMMON INK CHAMBER
9 INK CHAMBER FORMATION BOARD
10 NOZZLE ORIFICE
11 NOZZLE PLATE
12 ROW OF NOZZLES
13 PRESSURE CHAMBER
14 PRESSURE CHAMBER FORMATION BOARD

15 VIBRATION PLATE
16 SUPPLY-SIDE COMMUNICATION PORT
17 COVER MEMBER
18 PIEZOELECTRIC VIBRATOR
21 PIEZOELECTRIC LAYER
22 COMMON ELECTRODE
23 DRIVE ELECTRODE
24 UPPER PIEZOELECTRIC LAYER
25 LOWER PIEZOELECTRIC LAYER
26 UPPER COMMON ELECTRODE
27 LOWER COMMON ELECTRODE

The invention claimed is:

1. A liquid ejection head, comprising:

a liquid chamber, which stores liquid therein;

a nozzle orifice, adapted to eject a liquid droplet therefrom;

a pressure generating portion, provided in a liquid channel communicating with the liquid chamber and the nozzle orifice;

a liquid supply port, arranged between the liquid chamber and the pressure generating portion, wherein an inertance of the nozzle orifice Mn and an inertance of the liquid supply port Ms are greater than an inertance of the pressure generating portion Mc; and wherein the inertance of the nozzle orifice Mn, the inertance of the liquid supply port Ms and the inertance of the pressure generating portion Mc are expressed as the following equations:

$$Mn=\rho Ln/Sn;$$

$$Ms=\rho Ls/Ss; \text{ and}$$

$$Mc=\rho Lc/Sc;$$

where ρ denotes a density of liquid, Ln denotes a length of the nozzle orifice, Sn denotes a cross-section of the nozzle, Ls denotes a length of the liquid supply port, Ss denotes a cross-section of the liquid supply port, Lc denotes a length of the pressure generating portion and Sc denotes the cross-section of the pressure generating portion, and wherein the nozzle orifice includes a tapered inner surface.

2. The liquid ejection head as set forth in claim 1, wherein each of the inertance of the nozzle orifice and the inertance of the liquid supply port is set so as to be greater than double of the inertance of the pressure generating portion.

3. The liquid ejection head as set forth in claim 1, wherein the pressure generating portion comprises:

a pressure chamber;

a nozzle communication port, communicating with a first longitudinal end of the pressure chamber and the nozzle orifice; and a supply-side communication port, communicating with a second longitudinal end of the pressure chamber and the liquid supply port; and wherein longitudinal dimension of the pressure chamber is set to 1.1 mm or less.

4. The liquid ejection head as set forth in claim 1, wherein a natural period of the pressure generating portion is set to 7 μm or less.

5. The liquid ejection head as set forth in claim 1, wherein a cross section of the liquid channel at the nozzle orifice is smaller than a cross section of the liquid channel at the pressure generating portion; and wherein a cross section of the liquid channel at the liquid supply port is smaller than the cross section of the liquid channel at the pressure generating portion.

6. An apparatus, comprising the liquid ejection head as set forth in claim 1.

7. A liquid ejection head, comprising:

a liquid chamber, which stores liquid therein;

a nozzle orifice, adapted to eject a liquid droplet therefrom;

a pressure chamber, provided in a liquid channel communicating with the liquid chamber and the nozzle orifice; and a liquid supply port, arranged between the liquid chamber and the pressure chamber, wherein an inertance of the nozzle orifice Mn and an inertance of the liquid supply port Ms are greater than an inertance of the pressure chamber Mc;

wherein the inertance of the nozzle orifice Mn, the inertance of the liquid supply port Ms and the inertance of the pressure chamber Mc are expressed as the following equations:

$$Mn=\rho Ln/Sn;$$

$$Ms=\rho Ls/Ss; \text{ and}$$

$$Mc=\rho Lc/Sc;$$

where ρ denotes a density of liquid, Ln denotes a length of the nozzle orifice, Sn denotes a cross-section of the nozzle, Ls denotes a length of the liquid supply port, Ss denotes a cross-section of the liquid supply port, Lc denotes a length of the pressure chamber and Sc denotes a cross-section of the pressure chamber, and wherein the nozzle orifice includes a tapered inner surface.

8. The liquid ejection head as set forth in claim 7, wherein each of the inertance of the nozzle orifice and the inertance of the liquid supply port is set so as to be greater than double of the inertance of the pressure chamber.

9. The liquid ejection head as set forth in claim 7, wherein a cross section of the liquid channel at the nozzle orifice is smaller than a cross section of the liquid channel at the pressure chamber; and wherein a cross section of the liquid channel at the liquid supply port is smaller than the cross section of the liquid channel at the pressure chamber.

10. An apparatus, comprising the liquid ejection head as set forth in claim 7.

* * * * *